United States Patent [19]

Safrit et al.

[11] 4,412,433

[45] Nov. 1, 1983

[54] PANTYHOSE WITH INTEGRALLY KNIT CROTCH AREA

[75] Inventors: Sam C. Safrit, Pfafftown; Edward L. Cassidy; Melvin C. Euliss, both of Burlington, all of N.C.

[73] Assignee: Kayser-Roth Hosiery, Inc., Burlington, N.C.

[21] Appl. No.: 300,035

[22] Filed: Sep. 8, 1981

[51] Int. Cl.[3] ..... A41B 9/04

[52] U.S. Cl. ..... 66/177; 66/182; 66/198; 2/409

[58] Field of Search ..... 66/176, 177, 182, 187, 66/198; 2/409

[56] References Cited

U.S. PATENT DOCUMENTS

| | | | |
|---|---|---|---|
| 2,809,510 | 10/1957 | West | 66/177 |
| 3,566,624 | 3/1971 | Burleson | 66/177 |
| 3,933,013 | 1/1976 | Cassidy, Sr. | 66/177 |
| 4,195,497 | 4/1980 | Goldstein et al. | 66/185 |
| 4,213,312 | 7/1980 | Safrit et al. | 66/177 |
| 4,282,728 | 8/1981 | Tapp et al. | 66/182 |

FOREIGN PATENT DOCUMENTS

| | | | |
|---|---|---|---|
| 2256490 | 5/1974 | Fed. Rep. of Germany | 66/177 |
| 861232 | 2/1961 | United Kingdom | 66/176 |
| 1380131 | 1/1975 | United Kingdom | 66/177 |

*Primary Examiner*—Wm. Carter Reynolds
*Attorney, Agent, or Firm*—Bell, Seltzer, Park & Gibson

[57] ABSTRACT

The crotch area is integrally knit with the pantyhose blanks to eliminate the need for separately knit and cut crotch patches. The integrally knit crotch area includes a repeating four-course pattern of course portions with certain of the course portions including alternating jersey stitches and tuck loops to form openings in the crotch area and provide ventilation thereto. The repeating course portions also include selected courses with a hydrophilic yarn knit in plated relationship and on the inside of the body yarn to provide moisture-absorbing characteristics to the crotch area.

4 Claims, 4 Drawing Figures

PANTYHOSE WITH INTEGRALLY KNIT CROTCH AREA

FIELD OF THE INVENTION

This invention relates generally to a pantyhose with an integrally knit crotch area and more particularly to such a pantyhose in which the integrally knit crotch area is provided with openings to provide ventilation and a hydrophilic yarn is plated on the inside of the crotch area to provide moisture-absorbing characteristics to said crotch area.

BACKGROUND OF THE INVENTION

Many pantyhose currently being manufactured are provided with a separately knit, usually diamond-shaped, crotch patch which is sewn in position in the crotch area when two pantyhose blanks are sewn together. This procedure is both costly and time consuming because the crotch patch or gusset is separately knit and then must be cut to shape before it is manually sewn into the preslit pantyhose blanks.

The Albert C. Gaither U.S. Pat. No. 3,815,156 recognizes the desirability and advantages of providing ventilation in the crotch area of a pantyhose and discloses the use of a separately knit diamond-shaped crotch patch which is knit of an open mesh of "fishnet" construction. However, this separately knit crotch patch must be cut to shape and then sewn in position in the crotch of the pantyhose and it still does not provide the desirable moisture-absorbing characteristics.

In order to provide both ventilation and moisture-absorbing characteristics, it is the present practice to cut crotch patches from a separately knit two-layer fabric with the outer layer being knit of a stretchable nylon yarn and the inner layer being knit of a moisture-absorbing or hydrophilic yarn, such as cotton. The two layers are integrally knit together at spaced-apart locations and are provided with openings to provide ventilation while the inner layer provides moisture-absorbing characteristics thereto. However, this type of two-layer crotch patch fabric is expensive to produce and still must be cut to shape and manually sewn into position in the crotch area of the pantyhose.

SUMMARY OF THE INVENTION

With the foregoing in mind, it is an object of the present invention to provide a pantyhose with an integrally knit crotch area which is formed during the knitting of the pantyhose blanks and thereby eliminates the costly separate knitting, cutting and sewing involved in forming pantyhose with separate crotch patches of the type described above. The integrally knit crotch area of the present invention also includes openings to provide ventilation and a hydrophilic yarn plated on the inside to provide moisture-absorbing characteristics to the crotch area.

The integrally knit crotch area of the present invention is formed by knitting a substantially rectangular area of course portions in each of the stocking blanks with the same body yarn being knit in the crotch area as is knit in the adjacent areas of the pantyhose. A reinforcing yarn is knit in selected ones of these course portions to increase the bulk of the crotch area and a pattern of tucks is formed to provide openings in the crotch area for ventilation. A hydrophilic yarn, such as cotton, is knit in plated relationship on the inside and in selected course portions of the body yarn to provide moisture-absorbing characteristics to the crotch area. The knitting of the body yarn, reinforcing yarn, and cotton yarn in the crotch area provides the integrally knit crotch area with an appearance which is somewhat similar to the appearance of the separately knit and sewn-in two-layer crotch patch heretofore used.

The integrally knit crotch area includes a plurality of course portions forming a substantially rectangular are in the panty portions of the each of the pantyhose blanks. The course portions of the crotch area include a repeating four-course pattern with the first course portion being knit of jersey stitches of hydrophobic body yarn in every wale and with an additional hydrophobic yarn knit in plated relationship with the body yarn in every wale. A second course portion of jersey stitches of the body yarn is knit in every wale and with an additional hydrophobic yarn knit in plated relationship with the body yarn in selected spaced-apart pairs of adjacent wales and floating inside of multiple wales between the selected pairs of adjacent wales. A third course portion is knit of alternating pairs of adjacent jersey stitches and two-wale tuck loops of the body yarn. A fourth course portion of jersey stitches is knit of the body yarn in every wale and with a hydrophilic yarn knit in plated relationship and on the inside of the body yarn. The repeating pattern of course portions with alternating jersey stitches and tuck loops of the body yarn provides openings in the crotch area to provide ventilation thereto and the repeating course portions with the hydrophilic yarn on the inside provides moisture-absorbing characteristics to the crotch area.

The pantyhose blanks with the integrally knit rectangular crotch area of course portions are then slit in a walewise direction and from the open upper end downwardly to a location near the lower end of the rectangular crotch area. The corresponding cut edges of the slits in the pantyhose blanks are then sewn together by a single U-shaped seam. The use of a single U-shaped seam permits the pantyhose to be formed on existing automatic pantyhose sewing machines and in an economical manner.

DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
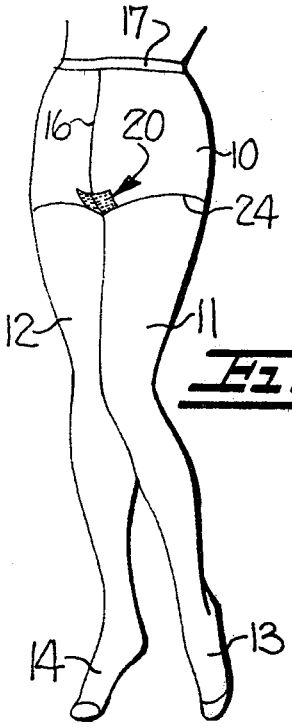
FIG. 1 is a perspective front view of the pantyhose garment constructed in accordance with the present invention and being illustrated in substantially the condition the pantyhose assumes when being worn.

The present pantyhose, as illustrated in FIG. 1, includes a panty portion 10 with integrally knit leg portions 11 and 12 and respective foot portions 13, 14. The panty portion 10 is illustrated as being formed in the conventional manner by forming longitudinal or walewise slits, as indicated by the dash-dot line 15 in FIG. 2, extending downwardly from the upper or waist end portion of each of two elongated pantyhose blanks and then seaming together the adjacent slit edges along a U-shaped seam line 16 in the well-known manner. The seam 16 extends from the waist opening at the front and downwardly through the crotch and up the rear to the waist opening so that the seam assumes a substantially U-shaped configuration.

Figure 2:
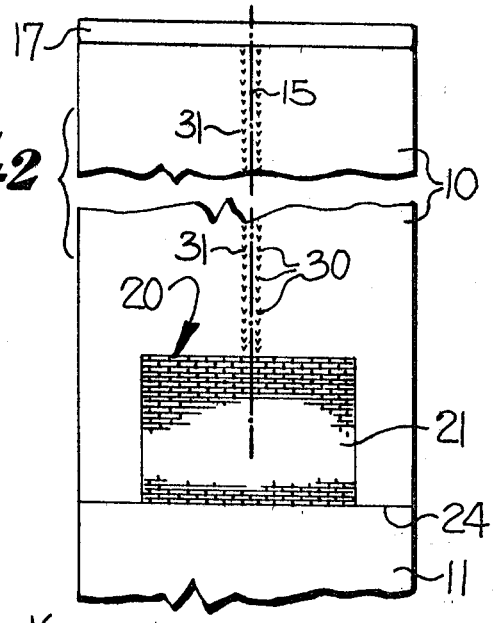
FIG. 2 is a fragmentary enlarged elevational view of the upper portion of a pantyhose blank in flattened condition and illustrating the substantially rectangular configuration of the course portions forming the integrally knit crotch area.
Figure 4:
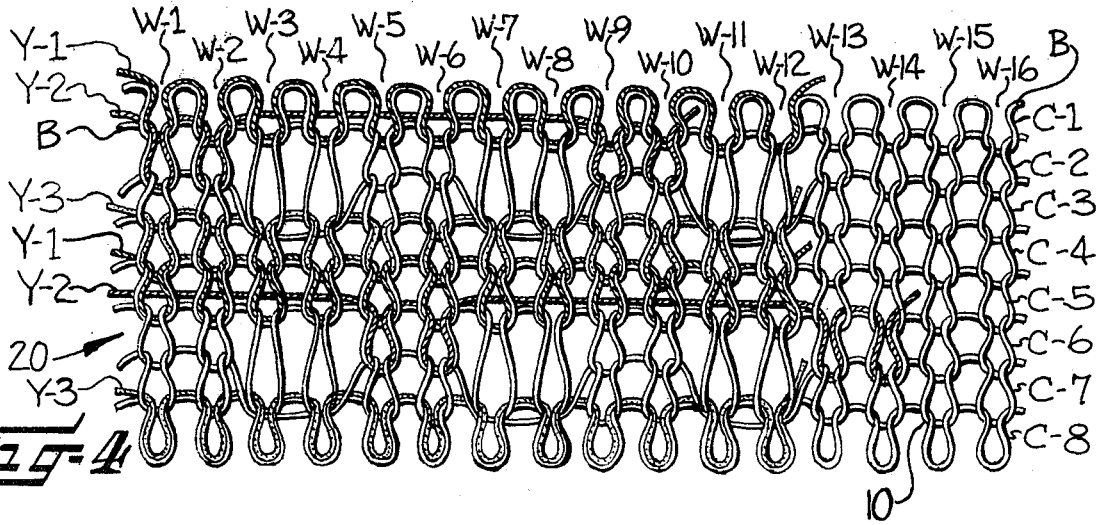
FIG. 4 is a greatly enlarged view of the stitch construction, being taken substantially in the rectangular area 4 in FIG. 3 and with the fabric being shown in highly stretched condition.

The upper waist opening of the panty portion 10 is provided with an elastic turned welt 17, or it may be provided with an elastic band or tape sewn thereto. The integrally knit crotch area, broadly indicated at 20, is formed by knitting substantially rectangular areas of course portions, respectively indicated at 21 and 22, during the knitting of each of the two elongated pantyhose blanks. As illustrated in FIG. 2, the elongated pantyhose blank is knit by first forming the turned welt 17 and then knitting the panty portion 10 of a body yarn, as indicated at B in FIG. 4, such as a 40-denier thermoplastic nylon textured yarn having substantially stretchable, retractable, and smooth conforming fit characteristics. The body yarn B is hydrophobic and has a sufficient amount of stretchability that the panty portion 10 of the pantyhose will fit a wide range of body sizes. The body yarn B is knit in very course, including the course portions forming the rectangular area 21, down to the line 24 in FIG. 2 which demarks the lower end of the panty portion 10. At this point, the leg 11 is knit by changing the yarn to a lighter denier, such as a 20-denier textured nylon yarn to provide stretchability and a sheer appearance to the leg 11.

The rectangular area of course portions 21 is knit during the formation of the lower portion of the panty portion 10 of the pantyhose blank. The width and length of the crotch area in each pantyhose blank may vary as desired. It has been found that, when the pantyhose blank is knit on a machine having 402 needles, a satisfactory crotch area is formed if the course portions are knit on 118 needles so that the width conforms to approximately one-fourth of the circumference of the pantyhose blank. The rectangular area 20 of course portions 21 includes a repeating four-course pattern, two repeats of which are shown in courses C-1 through C-8 in FIG. 4. The first course portion C-1 is knit of plain jersey stitches, wales W-1 through W-12, with the same body yarn B as is knit throughout the panty portion 10. An additional or reinforcing yarn Y-1 is knit in plated relationship and inside of the body yarn B to add bulk to the crotch area. The yarn Y-1 is preferably hydrophobic, such as 70-denier textured stretchable nylon. To aid in identification, the yarn Y-1 is cross-hatched in one direction. If it is desired to provide greater moisture-absorbing characteristics to the crotch area, the additional yarn Y-1 could be a hydrophilic yarn, such as cotton or rayon.

The second course portion C-2 is also formed of plain jersey stitches of the body yarn B in every wale and with elongated pairs of adjacent stitch loops being formed in spaced-apart wales, as illustrated in wales W-3, W-4, W-7, W-8 and W-11, W-12, in a manner to be presently described. The second course portion C-2 also includes an additional yarn Y-2, which is preferably a hydrophobic yarn such as 70-denier textured stretchable nylon, knit in plated relationship with the body yarn in selected spaced-apart pairs of adjacent wales, wales W-1, W-2, W-9, W-10 and floating inside of multiple wales therebetween, wales W-3 through W-8. The yarn Y-2 is cross-hatched in the opposite direction from the yarn Y-1, for ease of identification. The selected knitting and floating of the yarn Y-2 enhances the formation of the ventilation openings in the crotch area, in a manner to be presently described.

The third course portion C-3 is knit of alternating jersey stitches and tuck loops and is knit entirely of the body yarn B. The jersey stitches are knit in pairs of adjacent wales, wales W-1, W-2, W-5, W-6 and W-9, W-10 while the tuck loops extend over pairs of adjacent wales, wales W-3, W-4, W-7, W-8, and W-11, W-12 and are formed in the usual manner by feeding the body yarn to the corresponding needles forming these wales while holding the previously formed loops thereon and elongating the same. The formation of the two-wale tucks and the elongated stitches formed solely of the body yarn B provides definite openings in the crotch area fabric to provide ventilation to the crotch area.

The fourth course portion C-4 is formed of plain jersey stitches of the body yarn B in every wale and with a hydrophilic yarn, such as cotton or rayon Y-3 knit in plated relationship and on the inside of the body yarn B. The yarn Y-3 is preferably a cotton yarn of 96 single count and is plated on the inside of every wale of this course portion C-4 to provide moisture-absorbing characteristics to the crotch area. The yarn Y-3 is speckled to aid in identification.

The second four-course repeat of the area of course portions 21, as illustrated in courses C-5 through C-8, is formed in the same manner as the first repeating four-course pattern C-1 through C-4, except that the yarn Y-2 is knit and floated in course C-6 in staggered relationship to the knitting and floating of the yarn Y-2 in the course C-2 in the first repeat. As illustrated in course C-6, the yarn Y-2 is knit in adjacent pairs of wales W-5, W-6 and W-13, W-14 and floated across 6 wales therebetween, as illustrated in wales W-7 through W-12. The staggered knitting and floating of the yarn Y-2 in successive repeating four-course patterns provides a staggered pattern to the fabric in the crotch area.

It is preferred that the rectangular area 21 of course portions in the crotch area cover substantially 90 to 100 courses. As explained above, the rectangular area 21 of partial course portions is preferably 118 wales wide so that the length or vertical dimension of the rectangular area 21 of course portions is substantially the same as the width. It is also preferred that walewise rows of tuck stitches, indicated at 30, 31 in FIG. 2, be provided above the rectangular area 21 of course portions 21 to serve as a slitting guide to aid the operator in slitting the pantyhose blank in a walewise direction and to equally divide the rectangular area 21 when the slit is formed, along the dash-dot line 15 in FIG. 2.

Figure 3:
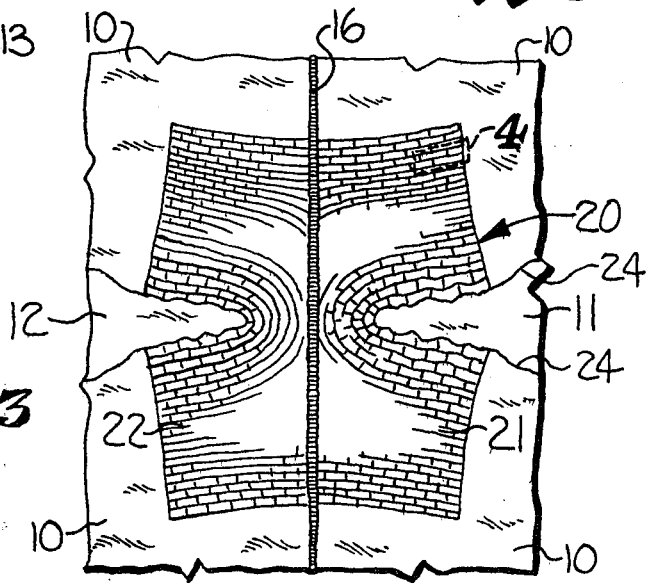
FIG. 3 is a fragmentary elevational view of the crotch area of the finished pantyhose with the legs being separated and illustrating the manner in which the U-shaped seam connects the integrally knit crotch areas of adjacent pantyhose blanks.

When the knitting of the pantyhose blanks is completed, and the walewise slits formed therein, the slit edges of pairs of pantyhose blanks are stitched together with the substantially U-shaped overedge seam 16 to form the ventilated and moisture-absorbing crotch area 20, as illustrated in FIG. 3. The integrally knit crotch area 20 somewhat simulates the appearance of the separately knit crotch patches heretofore used and also provides ventilating and moisture-absorbing characteristics. However, the crotch area 20 is knit during the knitting of the pantyhose blanks and does not require the usual separate knitting and cutting operations and the more complicated sewing operation.

In the drawings and specification, there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A pantyhose including a panty portion, and integrally knit leg and foot portions, said panty portion being knit of a hydrophobic body yarn in every course, said body yarn being stretchable and providing stretchability and smooth conforming fit characteristics to said panty portion, said panty portion including an integrally knit crotch area characterized by ventilating and moisture-absorbing characteristics, said crotch area comprising a plurality of course portions, said course portions of said crotch area including a repeating four-course pattern comprising a first course portion of jersey stitches of said body yarn in every wale and with an additional yarn knit in plated relationship with said body yarn in every wale, a second course portion of jersey stitches of said body yarn in every wale and with an additional hydrophobic yarn knit in plated relationship with said body yarn in adjacent pairs of spaced-apart wales and floating inside of multiple wales between said selected spaced-apart wales, a third course portion of pairs of adjacent jersey stitches and alternating with two-wale tuck loops knit only of said body yarn, and a fourth course portion of jersey stitches of said body yarn in every wale and with a hydrophilic yarn knit in plated relationship and on the inside of said body yarn, said repeating course portions with alternating jersey stitches and two-wale tuck loops of said body yarn providing openings in said crotch area to provide ventilation thereto, said second and third course portions including wales of jersey stitches knit of said body yarn only and positioned between pairs of said two-wale tuck loops at said multiple wales to provide plural wales of said body yarn only between the openings provided by said two-wale tuck loops, and said repeating course portions with said hydrophilic yarn on the inside providing moisture-absorbing characteristics to said crotch area.

2. A pantyhose according to claim 1 wherein said additional hydrophobic yarn in said second course portion floats inside of six wales between said pairs of adjacent wales.

3. A pantyhose according to claim 1 wherein the wales in which said additional hydrophobic yarn is knit in said second course portions of alternate repeating four-course patterns are staggered, relative to the wales in which said additional hydrophobic yarn is knit in said second course portions of intervening repeating four-course patterns.

4. A pantyhose according to claim 1 wherein the width of said crotch areas encompasses approximately one-fourth of the wales in said panty portion.

* * * * *